United States Patent [19]

Knoben et al.

[11] Patent Number: 5,006,826

[45] Date of Patent: Apr. 9, 1991

[54] TRIP DEVICE FOR AN ELECTRICAL SWITCH AND AN ELECTRICAL SWITCH WITH THIS TRIP DEVICE

[75] Inventors: Jozef H. A. Knoben, Hengelo; Jan B. Wensink, Hengevelde, both of Netherlands

[73] Assignee: Holec Systemen en Componenten B.V., Hengelo, Netherlands

[21] Appl. No.: 460,516

[22] Filed: Jan. 3, 1990

[30] Foreign Application Priority Data

Jan. 3, 1989 [NL] Netherlands ..... 8900007

[51] Int. Cl.[5] ..... H01H 75/12

[52] U.S. Cl. ..... 335/35; 335/172; 335/23; 335/179

[58] Field of Search ..... 335/21, 35, 38, 41, 335/23, 166, 170, 172–176, 119, 120, 121, 128, 194, 179

[56] References Cited

U.S. PATENT DOCUMENTS

| | | | |
|---|---|---|---|
| 3,534,304 | 10/1970 | Robinson | 335/177 |
| 4,288,770 | 9/1981 | Gillette . | |
| 4,595,895 | 6/1986 | Fujii et al. | 335/35 |
| 4,731,692 | 3/1988 | Dvorak et al. . | |
| 4,808,952 | 2/1989 | Berner et al. | 335/35 |

FOREIGN PATENT DOCUMENTS

A0073002 8/1981 European Pat. Off. .

*Primary Examiner*—Leo P. Picard
*Assistant Examiner*—Lincoln Donovan
*Attorney, Agent, or Firm*—Watson, Cole, Grindle & Watson

[57] ABSTRACT

Trip device of the suction or pull-in armature type, having a yoke (18; 35) supporting a fixed permanent magnet (22) and a movable elongated armature (23) having a head member (25). The armature (23) and the yoke (18; 35) forming a first magnetic circuit for holding the armature (23) in a first position with the permanent magnet (22), in which first position the head member (25) protrudes outside the yoke (18; 35). For moving the armature (23) electromagnetically and/or electrothermally to a second position in which the head member (25) protrudes further outside the yoke (18; 35), the yoke (18; 35) is provided with electrothermal bimetal device (33; 37). For moving the armature (23) to the second position independently of the polarity of an electrical current, a second magnetic circuit is provided, consisting of a further yoke and one or more magnet windings (30), or consisting of a pair of mutually magnetically separate branches (44, 45; 50, 51) magnetically connected in series with the first magnetic circuit, and one or more magnet windings (46) for mutually oppositely magnetizing the branches (44, 45; 50, 51).

22 Claims, 4 Drawing Sheets

TRIP DEVICE FOR AN ELECTRICAL SWITCH AND AN ELECTRICAL SWITCH WITH THIS TRIP DEVICE

The invention relates to a trip device for an electrical switch, comprising a yoke of magnetic material supporting a movably arranged elongated armature, an end section of said armature protruding outside the yoke, a fixedly arranged permanent magnet, the armature and the yoke forming a magnetic circuit for holding the armature in a first position under the influence of the magnetic field of the permanent magnet, spring means engaging the armature, at least one magnet winding for moving the armature electromagnetically to a second position, in which second position the said end section of the armature protrudes further outside the yoke than in the first position, and bimetal means for moving the armature thermally to the second position.

A trip device of this type, based on the so-called suction or pull in armature principle, is used, inter alia, for activating electrically, the switching mechanism in switches for the protection of electrical energy distribution installations and is known per se from U.S. Pat. No. 4,288,770.

This known trip device comprises an approximately U-shaped yoke of magnetic material, between the legs of which the at least one magnet winding and the permanent magnet being arranged adjacent to one another. The at least one magnet winding is cylindrical in shape, within which a plunger type armature of magnetic material can move. With this arrangement, one end of the armature is located opposite the permanent magnet, while the other end, supported by a partition, protrudes to the outside at the open side of the yoke. This protruding end is provided with a head member, a compression spring being fitted between said head member and the partition in the yoke and exerting on the armature a force which is directed towards the outside with respect to the yoke. The bimetal means engaging the armature react to the ambient temperature in the housing of the switch in which the trip device is used.

In the normal operating position, the armature is held in the first position under the influence of the permanent magnet, against the force of the compression spring. The position of the armature can now be influenced by the at least one magnet winding. For this purpose, this magnet winding is energized with the aid of an electronic circuit as soon as, for example, the current to be monitored has exceeded a preset limiting value. The magnetic field generated then exerts on the armature a force which is opposed to the force of the permanent magnetic field acting on the armature but acts in the same direction as the force exerted on the armature by the compression spring. When the force exerted on the armature by the magnet winding and compression spring is greater than the force of the permanent magnet acting on the armature, the armature will be moved to its second position. This movement can be used to actuate a switching mechanism.

If the ambient temperature rises above a certain limiting value, for example as a consequence of an overload situation, the armature will be moved to the second position via the bimetal means. This signifies that overload currents are detected only indirectly, via the ambient temperature. In practice, switching off a switch in accordance with standardized current/time curves can be accomplished insufficiently accurately by means of this type of indirect detection of overload currents.

U.S. Pat. No. 4,731,692 also discloses a trip device of the suction armature type, arranged for use in a switch for interrupting currents above a preset limiting value, such as, for example, short-circuit currents. As soon as the current to be monitored has exceeded the set limiting value, the at least one magnet winding is energized in such a way that the armature is moved to the second position under the influence of the magnetic field thus generated and with the aid of the spring means and against the influence of the permanent magnetic field, as a result of which the switch is switched off.

However, when the current to be monitored is flowing through a conductor, for example a conductor rail, located in the vicinity of the trip device, the magnetic field generated by this current can become so large that it counteracts the magnetic field of the permanent magnet and even attenuates the latter to such an extent that the armature will be moved to the second position under the influence of the compression spring even before the set limiting value has been exceeded. In order to eliminate this interfering effect, an auxiliary winding has been added which compensates for the interfering magnetic field by generating an equally large but opposite magnetic field which assists the action of the permanent magnet on the armature. The energizing of this auxiliary winding is put out of operation as soon as the magnet winding receives a switch-off command via an electronic circuit.

In order to be able to operate in the desired manner, the trip device is necessarily provided with an electronic circuit. However, the use of an electronic circuit signifies a rise in the total costs of the device and an increase in the susceptibility to breakdown.

As described above, the known trip devices are primarily arranged for use in switches for interrupting short-circuit currents above a preset limiting value. For alternating current applications, however, there is an important precondition, namely that switching off of the particular current preferably must be initiated at the moment at which the preset limiting value is exceeded, irrespective of the polarity of said current. Without extra measures, for example in the form of an electronic circuit, the devices according to the U.S. patents cited have a polarity-dependent switch-off function. This means that under certain conditions switching off is effected incorrectly, that is to say when the increase in the current to above the preset limiting value occurs in the half-cycle in which the direction of the current is counter to the current direction for attenuating the magnetic field of the permanent magnet.

In practice, electrical energy distribution installations and separate equipment (such as motors) frequently have to be protected not only against overload and/or short-circuit currents but also against fault currents to earth. Although the electrical installations and equipment can be protected by means of separate devices against these fault situations, there is currently a need, not only because of economic considerations but also from the standpoint of reliability, to combine the various protection functions in one device. Furthermore, the aim is to keep the size of these devices as small as possible so that the dimensions of the installation boxes customarily used in practice for the assembly of these devices can also remain restricted, or so that as many devices as possible can be incorporated in an installation box of predetermined dimensions.

The object on which the invention is based is now, in the first instance, to provide a trip device of the type specified in the preamble, which device can be made suitable in a simple manner for incorporating, as desired, either one of the abovementioned protection functions or a combination of two or more of these protection functions, and with which at least the short-circuit and overload current protection functions are independent of the polarity of the current to be monitored, without the necessity for electronic control circuits. The device must also be of compact construction.

According to the invention, this object is achieved in that the at least one magnet winding forms part of a further magnetic circuit for moving the armature to the second position independently of the polarity of an electric current flowing in the at least one magnet winding during operation, and in that the bimetal means are arranged for moving the armature electrothermally to the second position.

As a consequence of a suitable choice and mutual balancing of the electrothermal bimetal means, the strength of the permanent magnet, the construction of the magnetic circuit and the strength of the spring means, the trip device according to the invention is particularly suitable for use in automated electric switches for protecting electrical energy distribution installations in accordance with standardized current-/time curves.

Use of a further magnetic circuit in a suction type armature trip device according to the invention for influencing the magnetic force acting on the armature, for example under the influence of the current to be monitored which is flowing directly in the at least one magnetic winding, in such a way that said armature can be moved to its second position with the aid of the spring means offers the possibility for embodiments in which a magnetic force directly acting on the armature can be generated by means of the further magnetic circuit, or for embodiments in which the permanent magnet magnetic field acting on the armature can be influenced by means of the further magnetic circuit. In the text which follows these embodiments are indicated as the "active" or the "passive" principle respectively. Of course, combinations of the two principles are possible.

In general, a trip device based on the passive principle can be of compact design but, on the other hand, is more sensitive to external magnetic influences. A trip device based on the active principle is much less sensitive to external magnetic influences, but in general, in respect of dimensions, will be of larger construction.

In an embodiment of the trip device according to the invention, based on the active principle, the further magnetic circuit comprises a further yoke of magnetic material containing the said end section of the armature, the end of said end section merging into a head member having a higher magnetic resistance than the armature, which head member protrudes from a face of the further yoke towards the outside, the said end being located, in the first position of the armature, at a distance from the face of the further yoke through which the head member protrudes, and the at least one magnet winding being arranged around the end section of the armature.

In the first position of the armature, the end section and the head member, together with the further yoke, form a further magnetic circuit having a higher magnetic resistance than the magnetic circuit of which the permanent magnet constitutes part. This means that in the said end section of the armature there is no, or a negligibly small, magnetic field originating from the permanent magnet. However, under the influence of an electric current flowing through the at least one magnet winding, a magnetic field is generated in the further magnetic circuit, which magnetic field attempts to close via the further yoke and the end section of the armature. Irrespective of the polarity of this magnetic field, a force in the direction of the face of the further yoke through which the head member protrudes to the outside is consequently exerted on the end section of the armature. If this magnetic force is greater than the magnetic force originating from the permanent magnet and acting on the armature, a resultant force acting on the armature is generated, as a consequence of which said armature is moved, also under the influence of the spring means, to its second position.

According to a further embodiment of the invention, a geometrically compact construction is obtained in that the two yokes are combined in a single structural unit each yoke having an open U-shaped or a closed or virtually closed U-shaped cross-section. Suitable combinations are, inter alia, those with which the two yokes as a whole have an essentially U-, S-, E-, 8- or 9-shaped cross-section, two adjacent faces thereof being provided with a feed-through opening for the armature.

Although constructions of this type can thus be made up of two separate yokes, in yet a further embodiment of the invention the two yokes are integrated so as to form a single whole. By forming the two yokes as a single whole, a number of constructional problems with regard to the fixing of separate yokes, the alignment of the feed-through openings for the armature and the prevention of undesired air gaps between the contact surfaces of the yokes are avoided.

To also enable bimetal means to engage on the head member of the armature in these embodiments of the device according to the invention, which bimetal means can be, for example, of the directly heated type with which the current to be protected, or a value derived herefrom, flows directly through the bimetal itself, it is advantageous to manufacture the head member from plastic. Both a good electrical insulation and the intended higher magnetic resistance of the second magnetic circuit are achieved by this means.

The thermal characteristics of the trip device can, inter alia, be varied by varying the distance between the head member and the bimetal means engaging thereon. In an embodiment of the invention which is suitable for this purpose the head member and the armature are fixed such that they partly fit into one another. A construction of this type offers flexible adjustment possibilities. From the assembly technology standpoint, pin/-hole and screw connections are advantageous in this context.

A good guiding and support of the said end section of the armature and the head member is achieved in a still further embodiment of the present invention in that a sleeve of magnetically non-conducting material is fitted around the said end section of the armature and the part of the head member contained in the further yoke, the ends of said sleeve extending in feed-through openings of the further yoke for the armature, the said at least one magnet winding being disposed around said sleeve.

In an embodiment of the trip device according to the invention, which is based on the said passive principle for moving the armature to the second position, the further magnetic circuit comprises at least one pair of mutually magnetically separate branches of magnetically conducting material, which further magnetic circuit is connected magnetically in series with the one magnetic circuit and which at least one pair of branches is encircled by the at least one magnet winding in such a way that the branches are mutually oppositely magnetized by an electrical current flowing during operation in the at least one magnet winding, such that the resultant magnetic field acting on the armature becomes smaller than the magnetic field of the permanent magnet acting on it, in order to move the armature to the second position.

The functioning of this device can be understood as follows. Assume that the armature adopts its first position under the influence of the magnetic field of the permanent magnet and against the action of the spring means. In order to bring the armature into its second position by means of the spring means, the magnetic field in the total magnetic circuit will have to be suitably attenuated. The permanent magnet is chosen such that the magnetically separate branches of the second magnetic circuit are premagnetized close to, or to some extent into, their saturation region. Assuming that the branches have identical magnetic characteristics and are identically wound, the field amplification effected by the electric current in the at least one magnet winding in one branch will, as a consequence of the known non-linear magnetization characteristics of magnetic material at the transition to the saturation region, be smaller in size than the field attenuating effected at the same time in another branch. Consequently, in total there will be a net field attenuation of the magnetic field in the further magnetic circuit, independently of the polarity of the electric current at the given instant. Because the two magnetic circuits are connected magnetically in series, a desired polarity-independent attenuation of the magnetic field in the one magnetic circuit consequently results.

It is pointed out that European patent application No. 0,073,002 discloses a trip device for an electric switch, of the so-called hinged-armature type, with which device the passive principle is also utilized in order to move the hinged armature by electromagnetic means independently of polarity. In respect of design and characteristics, the hinged-flap armature construction differs to a great extent from the suction armature construction according to the invention. Combination of several protection functions, which is the main object of the present invention, requires significant modifications in the construction of trip devices of the hinged-armature type. This because of the rotating movement of the armature which precludes a direct action on the armature by means of, for example, one or more magnet winding as in the suction type armature trip device. The hinged-armature construction therefore offers those skilled in the art no basis for achieving the object on which the present invention is based.

In an advantageous further embodiment of the invention, which is simple from the assembly technology standpoint, of the trip device, based on the passive principle, the further magnetic circuit is formed by at least one opening made in the yoke, the sections of the yoke adjoining this at least one opening forming the at least one pair of mutually magnetically separate branches.

Instead of fitting the mutually magnetically separate branches in the yoke itself, this can also be effected, with an increase in the freedoms in dimensioning the trip device according to the invention, by forming the at least one pair of mutually magnetically separate branches of the further magnetic circuit in at least one body of magnetic material positioned in the longitudinal direction of the armature. The magnetic material of this body can, for example, have a different composition and different characteristics than the material of the yoke and/or the armature.

In an embodiment of the invention based on the above and functioning well in practice, the at least one body is essentially rod-shaped and has at least one opening extending in radial direction, such that the sections of the at least one body which adjoin the at least one opening, seen in the longitudinal direction, form the at least one pair of mutually magnetically separate branches.

It has been found that if the strength of the permanent magnet and the dimensions of the mutually magnetically separate branches are suitable chosen, an at least one magnet winding consisting of a single turn can suffice. If the dimensioning is suitable, an at least one magnet winding consisting of one or a few turns can also suffice in the embodiments of the trip device according to the invention which are based on the active principle. The at least one magnet winding can consequently be incorporated directly in the circuit to be protected and can be manufactured with a wire thickness such that there is no risk of impermissible evolution of heat or action of force as a consequence of a shortcircuit current arising in the (alternating) current circuit to be protected. A further advantage lies in the fact that with a magnet winding consisting of one or a few turns the compact dimensions of the trip device can also be preserved when using several magnet windings for the protection of poly-phase alternating current circuits. Of course, a suitable representative of the current or currents to be monitored can be fed to the at least one magnet winding by using, for example, one or more current transformers.

As already indicated above, there is also a need in practice for switches which can render electrical installations dead in response to the occurrence of fault currents to earth. In general, fault currents to earth are detected with the aid of a ring core transformer, the detection signal being used, after processing if necessary, to activate an electrical switch.

For actuating an electric switch under the influence of such a polarity-independent detection signal or a signal derived herefrom, an embodiment of the trip device according to the invention is provided with a further magnet winding, arranged around the armature and inside the one yoke, for attenuating electromagnetically the magnetic field of the permanent magnet in the one magnetic circuit by a further electric current in order to move the armature to the second position.

Because, in the trip device according to the invention, this further magnet winding is all that is arranged around the section of the armature of the one magnetic circuit, it is possible, without increasing the geometric dimensions of the trip device, to provide this further magnet winding with a number of turns such that only a relatively small electric current is required to generate a magnetic field of the desired strength. This has the advantage that electronic components of small (electrical) dimension can be used in the processing circuit for rendering the detection signal polarity-independent.

As already described above, the trip device according to the invention is provided with bimetal means for electrothermally activation of the armature. In an advantageous embodiment of the trip device according to the invention the bimetal means comprise at least one elongated electrothermal bimetal element, one end of said at least one bimetal element being fixed to the yoke and the other end being able to engage in a freely movable manner on the outwardly protruding end section of the armature or on the head member in order to move the armature to the second position during operation.

The elongated construction of the bimetal element has a number of advantages. Specifically, it has been found that the greater then length of the bimetal element the smaller the amount of electrical energy needed to effect the required displacement of said element for moving the armature. In other words, the trip device can be activated by relatively low overload currents. After an overload current has been removed, for example by switching it off, an elongated bimetal element will cool down sufficiently rapidly and assume its initial position, so that the trip device can be reset, for example manually. In the case under consideration, this therefore signifies that the armature is returned to its first position.

In a further embodiment of the trip device according to the invention, which is based on the above, the at least one elongated bimetal element is arranged in such a way that its longitudinal axis makes an acute angle with the longitudinal axis of the elongated armature. As a consequence of this sloping arrangement, relatively long bimetal elements can be used, with the advantages mentioned. Other practical arrangements with which relatively long bimetal elements can be used are indicated in the description of the embodiments.

The bimetal means can be either of the directly heated type or of the indirectly heated type. The indirectly heated type has the advantage that, when the trip device is used in, for example, a polyphase alternating current system, the bimetal elements can be provided with a number of heating elements equal to the number of phases.

Electrical energy distribution installations generally comprise one supply line to which several so-called group lines are connected. The installation as a whole is protected by a so-called main fuse, incorporated in the supply line, and a group fuse, incorporated in each group line. If necessary, the separate group lines can again be further subdivided into sub-groups, with associated sub-group fuses. Because, in the event of a fault in an installation, only that fuse which is closest before the location of the fault has to operate, inter alia, a standardized series of nominal current strengths to be protected is set up in order to be able to effect the desired switch-off selectivity.

Both the embodiments of the trip device according to the invention which are based on the active principle and those which are based on the passive principle are, in accordance with a further embodiment, made suitably adjustable for reacting to different nominal current strengths by positioning a shunt of magnetic material between the armature and the permanent magnet in order to influence the magnetic field in the one magnetic circuit.

By suitable setting of a magnetic shunt of this type, the trip device can not only be adjusted for operating at different current strengths but it is also possible easily to compensate for deviations as a consequence of manufacturing tolerances. In a relatively simple embodiment the shunt is a movably arranged plate.

Of course, the trip device can also be adjusted to different current strengths by increasing or reducing the number of turns of the magnet winding. In the case of the trip device according to the invention which is based on the active principle, there is also an extra possibility for adjustment via increasing or reducing the distance between the armature and the face of the further yoke located at the side of the head member of said armature.

The trip device according to the invention thus provides a device in which the said three protection functions can be combined in a structurally simple and compact manner, while, at the same time, the freedom exists to incorporate only one or more functions and to choose from the said active and/or passive principle.

Various national and international standards contain extensive guidelines for safety switches in electrical installations. Specifically, the values of the current strength and the associated switch-off period are fixed within specific limits. A further advantage of the trip device according to the invention is that with this device safety switches for electrical installations can be provided which, inter alia, comply with the European Standard CEE 19 "Specification for miniature power switches" (automated switches). The revised requirements with respect to the switch-off characteristics of safety switches as laid down in the draft regulations IEC 898 of the "International Electrotechnical Commission" can also be satisfied without any problem by the trip device according to the invention.

The invention consequently further relates to an electrical switch having a housing provided with at least one pair of contacts, a spring system and actuating means for bringing the at least one pair of contacts into the one or the other position under the influence of the action of the spring system, which actuating means comprise a trip device in accordance with the invention.

The invention is explained in more detail below with reference to preferred embodiments of the trip device and drawings, further advantages and embodiments of the device also being indicated. Components having a similar function and the same shape are indicated by the same reference numbers.

Figure 3A:
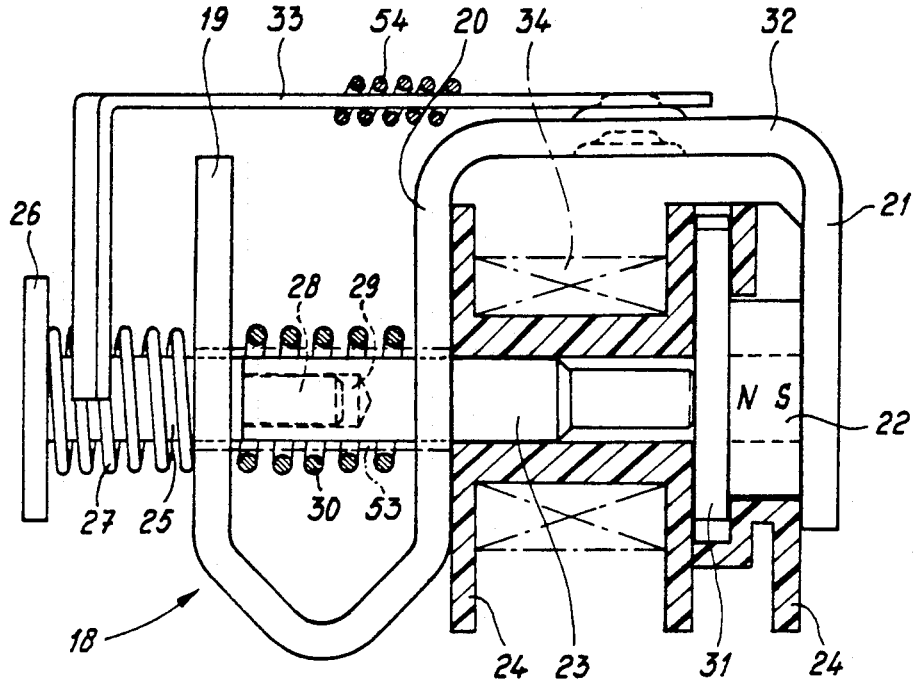
Figure 4A:
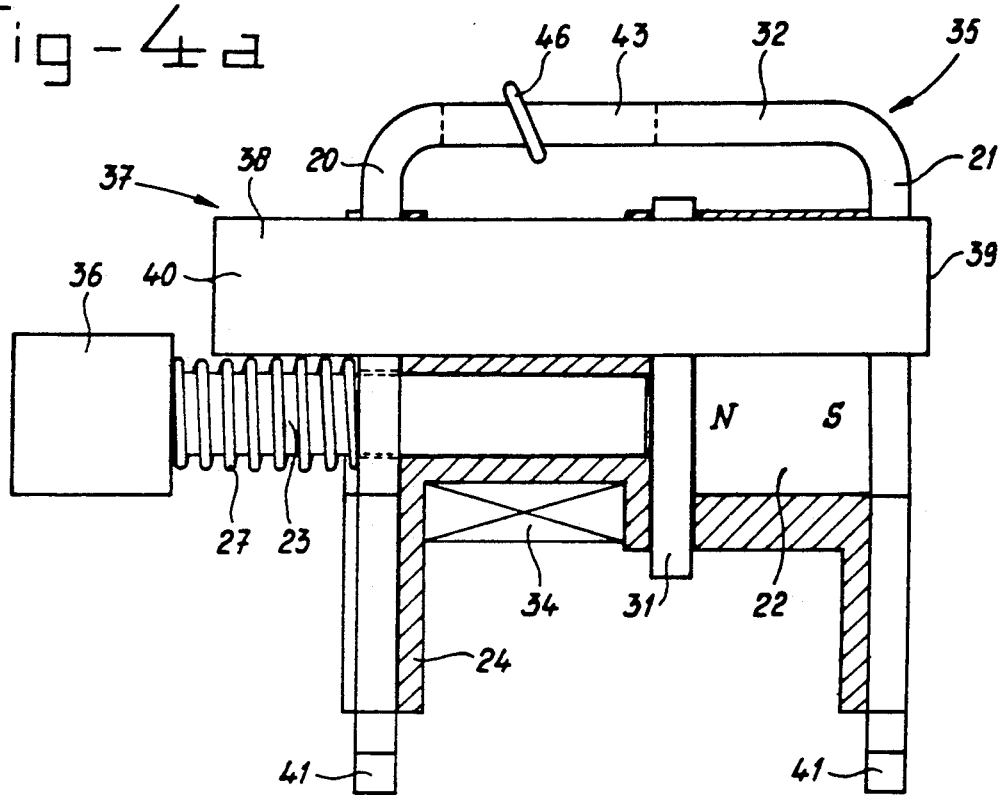
Figure 4B:
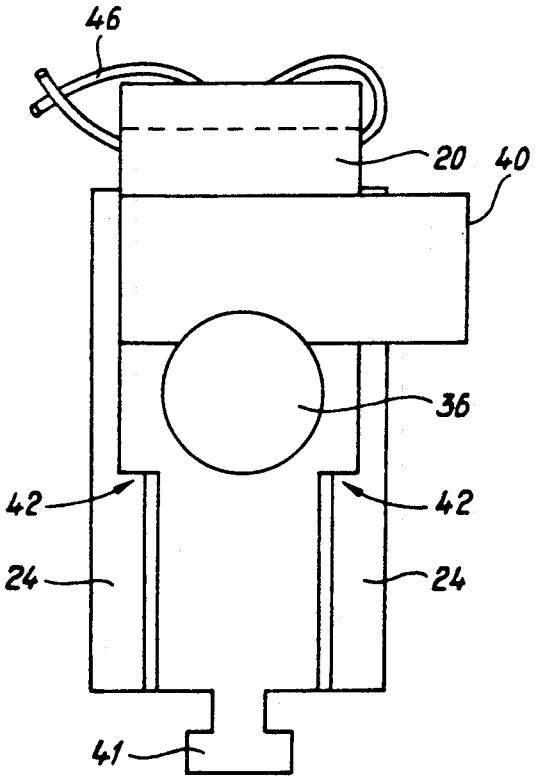
Figure 4C:
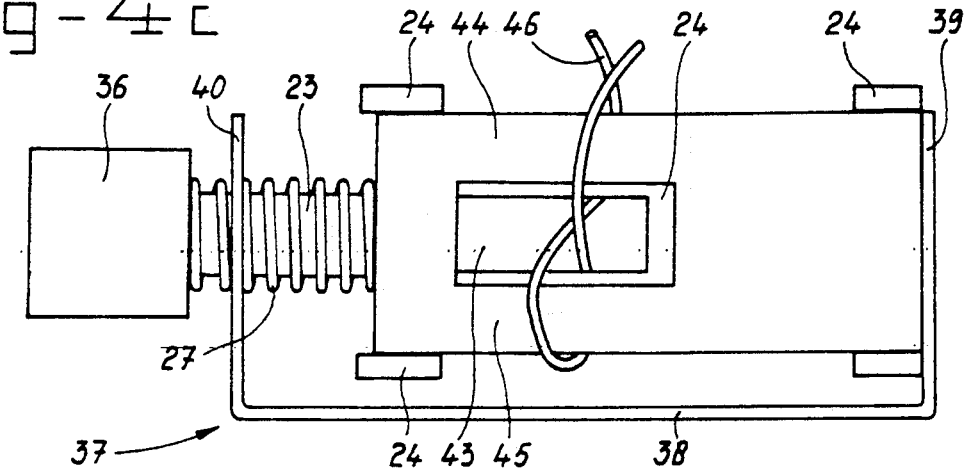
Figure 5:
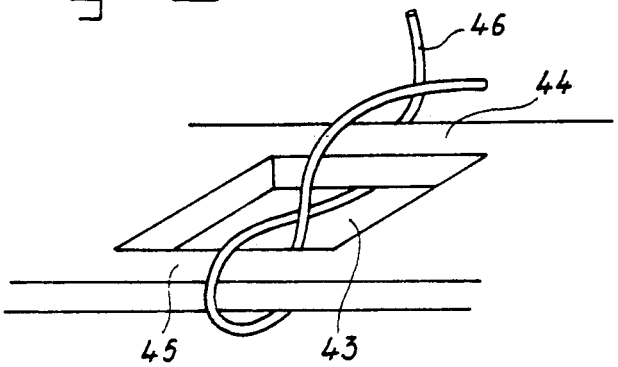
Figure 6:
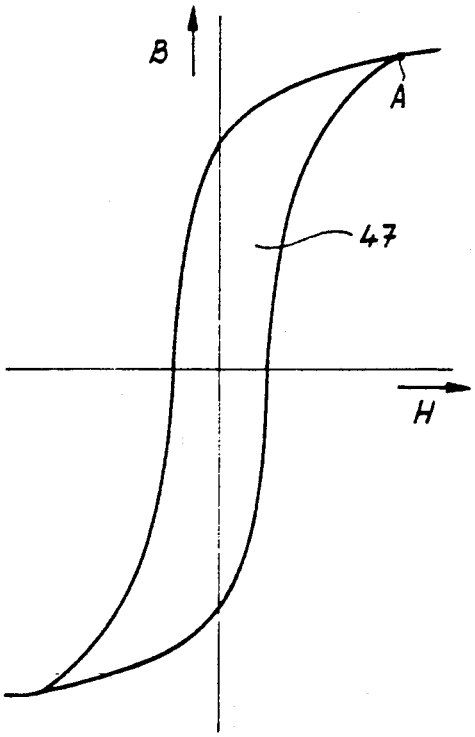

FIGS. 3*a* and *b* show diagrammatically various views of an embodiment of the trip device according to the invention which is based on the active principle;

FIGS. 4*a–c* show diagrammatically various views of a preferred embodiment of the trip device according to the invention which is based on the passive principle;

FIG. 5 shows diagrammatically, in a perspective view on an enlarged scale, a detail of the embodiment according to FIG. 4 with an assembled magnet winding;

FIG. 6 shows a plot of a hysteresis loop of magnetic material, and

Figure 7:
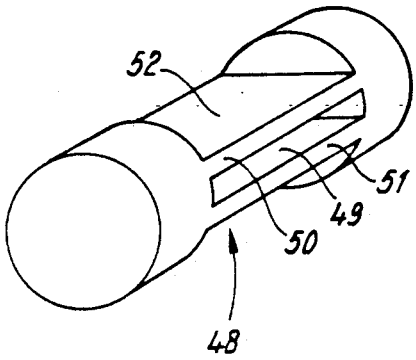

FIG. 7 shows diagrammatically a perspective view of a separate body with two magnetically separate branches.

Figure 1:
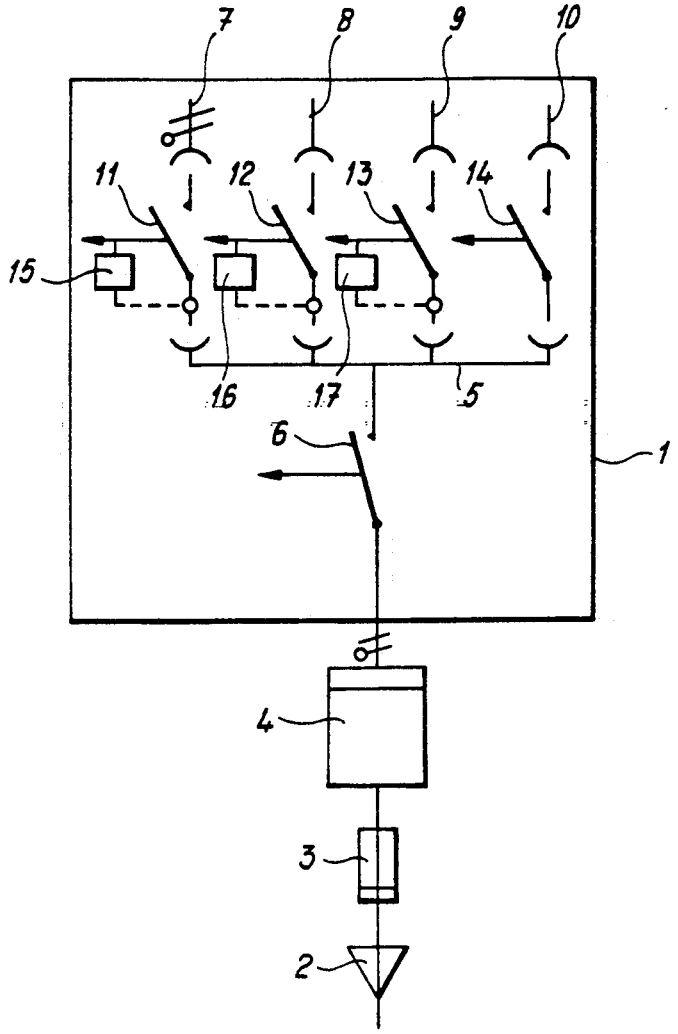
FIG. 1 shows a diagram of a conventional single-phase electrical energy distribution installation with four outgoing groups.

FIG. 1 shows a diagram of a conventional, single-phase electrical energy distribution installation for, for example, domestic connections. At the switching and distribution means, which are located in an installation box 1, electrical energy is supplied from a cable inlet 2, via a fuse 3 and a consumption meter 4, to a distribution rail 5.

A main automated switch 6 is incorporated between the distribution rail 5 and the consumption meter 4. In this example the distribution rail 5 is split into four outgoing groups 7, 8, 9 and 10, to which the electrical loads are connected. An automated switch 11, 12, 13 and 14 respectively is detachably incorporated between the distribution rail 5 and each outgoing group 7, 8, 9 and 10 in order to protect the outgoing groups against impermissible overload and short-circuit currents. The automated switches 11, 12 and 13 are further provided with a detection device 15, 16 and 17 respectively for fault currents to earth.

In practice, automated switches generally consist of one or more pairs of contacts, a spring system coupled thereto and actuating means for bringing the pairs of contacts into the closed or opened position under the influence of the action of the spring system. The actuating means can in general be activated by electromagnetic means, thermal means and manually. Ring core transformers are customarily used for detecting fault currents to earth, the lead and return lines of the electrical installation each forming a primary turn. A difference between the lead and return currents causes a voltage to be generated in a secondary winding of the ring core transformer and this voltage supplies a switch-off signal to the actuating means of the automated switch.

When a fault necessitating switching off of the energy supply occurs in an outgoing group of the electrical installation, it is, of course, desirable that only that automated switch which, seen from the energy supply side, is closest in front of the location of the fault is actuated. In order to achieve such a switch-off selectivity, fuses connected in series must be mutually tuned to one another in respect of their switch-off characteristics. In some electrical installations such high short-circuit currents can occur that, for example, the contacts in an automated switch fuse solidly together before the switch-off mechanism reacts. In order to prevent this, the fuse 3 is generally incorporated at the energy supply side of the electrical installation.

As a consequence of overload currents, such an evolution of heat can occur in the electrical conductors and the switching means of an electrical installation that, for example, fire can arise. This is because, depending on the heat capacity of the electrical conductors, the heat transfer from the conductors to the environment and the jacket surface of the conductors, the electric current flowing herethrough will cause a certain rise in temperature. Below a specific current strength, which is termed the nominal current strength, impermissible heating of the environment will not occur. Overload currents, that is to say currents with a strength above the nominal current strength, are, however, able in the course of time to cause an impermissible heating of the electrical conductors and their environment. It will be clear that the higher the overload currents the more rapdily a specific temperature rise will be achieved. Short-circuit currents are in general always impermissible and must be switched off as rapidly as possible.

Figure 2:
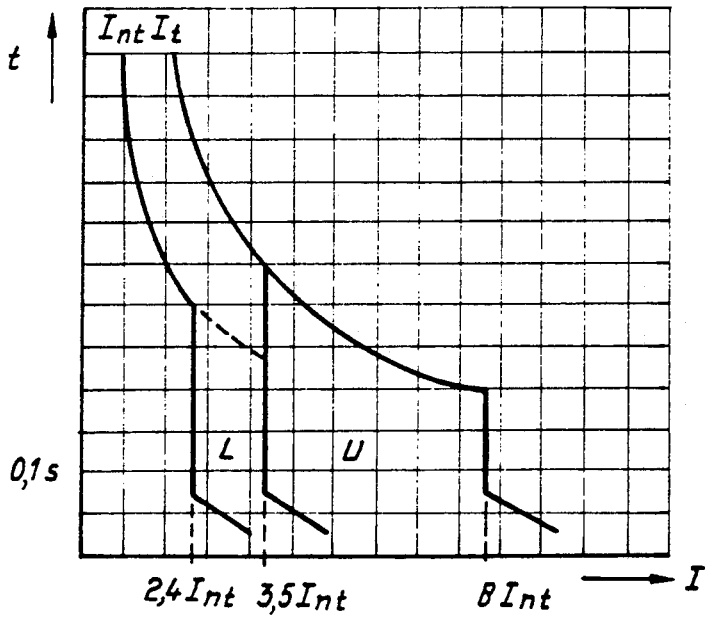
FIG. 2 shows a plot, on a logarithmic scale, of various current/time curves of automated switches for electrical energy distribution installations.

FIG. 2 shows a plot of current/time curves, which are also termed switch-off curves, for automated switches of the L and U type in accordance with European Standard CEE19. In these graphs the current strength I is plotted on the horizontal axis and the time t for which this current is permissible is plotted on the vertical axis. CEE Standard 19 recognizes a first current limit A at which the automated switch must not react within one hour, which first current limit is also termed the non-tripping current $I_{nt}$, and a second current limit B to which the automated switch must react within one hour, this second current limit also being termed the tripping current $I_t$. This CEE standard thus specifies a band within which the automated switch must trip.

The curved portion of the plots is the region in which switching off takes place as a consequence of overload currents (thermal switch-off region). The downwardly sloping righthand portion of the plot is the region in which switching off takes place as a consequence of short-circuit currents (magnetic switch-off region). Automated switches of the L type are optimally matched to the rise in temperature of the electric leads. The automated switches of the U type are generally used for equipment protection.

It is apparent from the above that the actuating means for an electrical switch for the protection of electrical energy distribution installations must be able to react, in a manner which may or may not be predetermined, to three types of fault situations, that is to say:

a. relatively low overload currents;
b. relatively high overload currents and short circuit currents;
c. fault currents to earth.

In practice, the fault situations indicated under a. and b. are frequently already monitored with the aid of a single combined device, while the function mentioned under c. is optional in this case. However, situations also arise in which only one or two of the fault situations mentioned must be monitored.

FIGS. 3*a* and *b* show diagrammatically various views of an embodiment of the trip device according to the invention for activating the switching mechanism of the switch under the influence of one or more of the abovementioned fault situations.

FIG. 3*a* is a side view, partially shown in cross-section, of an embodiment of the trip device based on the active principle, having an approximately S-shaped yoke 18 of magnetic material, such as soft iron, steel and the like, with legs 19, 20 and 21 located parallel to one another. A permanent magnet 22, for example made of ferroxdure, is arranged between the two legs 20 and 21. The north and south pole of the magnet 22 are indicated by N and S respectively. A rod-shaped armature 23 of magnetic material, such as, for example, soft iron or steel, is arranged so as to be movably supported in the extension of the magnetic axis of the permanent magnet 22. The adjacent legs 19 and 20 are provided with a feed-through opening such that the armature 23 can be moved through here.

The armature 23 and the permanent magnet 22 are held between the legs 20 and 21 of the yoke 18 by a support body 24 which is matched to their respective shapes. The support body 24 can advantageously be made of plastic, the legs of the yoke likewise being partially enveloped so that the support body 24 assumes a fixed position relative to the yoke 18. For clarity, the section of the support body 24 between the legs of the yoke is shown in cross-section.

The cylindrical head member 25 is fixed at the end of the armature 23 which faces away from the permanent magnet 22, this head member 25 having a stop 26 and a compression spring 27 being fitted between said stop 26 and the outwardly facing side of the leg 19. For clarity, the compression spring 27 is likewise shown in cross-section. At the end remote from the stop 26, the head member 25 is provided with a pin-shaped extension 28, which fits in a bore 29 in the longitudinal direction of the armature 23. The various features are as shown by broken lines in the figure. The head member 25 is fixed to the armature 23 via the pin-shaped end 28 in the bore 29. The head member 25 must be made of a material, for example of plastic which has a higher magnetic resistance than that of the armature 23.

It is self-evident that, for fixing the head member 25 to the armature 23, it is also possible, instead of making a bore in the armature 23, to make a bore in the head member 25 into which a pin-shaped end shaped on the armature 23 then fits. Other fixing methods, such as, for example, gluing or using a screw thread connection, can also be employed.

A magnet winding 30 is fitted around the armature 23 between the legs 19 and 20 of the yoke 18. For clarity, this magnet winding 30 is likewise shown in cross-section and, moreover, the connection ends hereof are not shown. If necessary, a sleeve 53 of non-magnetic material or material having a low magnetic permeability can be fitted around the armature 23 between the legs 19 and 20, as is indicated by dash and dot lines in the figure. The magnet winding 30 is then disposed around this sleeve 53. By allowing the ends of the sleeve 53 to extend into the respective feed-through openings in the legs 19 and 20 of the yoke 18, good guiding and support of the armature 23 and the head member 25 are obtained.

In addition, a shunt plate 31 of magnetic material which can be moved parallel to the leg 21 is fitted between the permanent magnet 22 and that end of the armature 23 which is opposite said magnet. The shunt plate 31 can be moved in the direction towards and away from the base side 32 of the yoke, which connects the legs 20 and 21 hereof.

The permanent magnet 22, the shunt plate 31, the section of the armature 23 which is located between the legs 20 and 21, as well as the legs 20 and 21 themselves, and the base side 32 of the yoke form a first magnetic circuit. The legs 19 and 20 and the section of the armature 23 which is surrounded by the magnet winding 30 form a second magnetic circuit.

In addition, one end of a L-shaped bimetal element 33 is attached to the base side 32, the other free end of said bimetal element being located between the leg 19 of the yoke 18 and the stop 26 of the head member 25 of the armature 23.

Figure 3B:
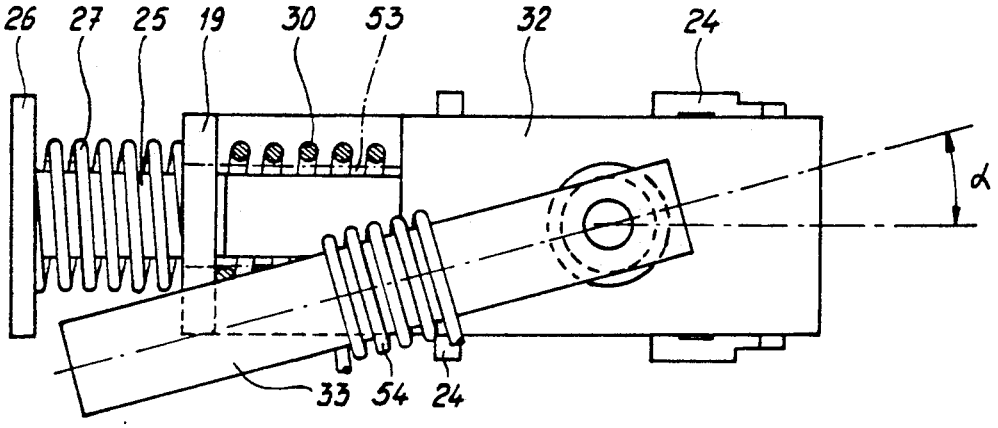

FIG. 3*b* shows the top view of the embodiment of the trip device according to the invention which is shown in side view in FIG. 3*a*. From this figure it can clearly be seen that the elongated section of the bimetal element 33 makes an acute angle a with the longitudinal axis of the elongated armature 23. As already mentioned, the sloping arrangement of the bimetal element 33 offers the possibility of being able to work with longer elements than would be the case if the bimetal were to be arranged in line with the armature. The longer the bimetal element, the smaller will be the energy supply which can suffice to provide a desired deflection, which signifies an increase in the sensitivity to overload currents. At the same time, the cooling surface of the bimetal element is larger, as a result of which this element returns more rapidly to its original position, as shown in FIG. 3, after a deflection. Consequently, after a thermal overload situation, the switch which has been switched off by the trip device can be switched on again more rapidly.

Of course, arrangements other than those shown are also possible to enable longer bimetal elements to be used. Thus, the bimetal element 33 can also be attached, shifted sideways relative to the longitudinal axis of the armature 23, to the base side 32 of the yoke. In such an eccentric arrangement, the section of the bimetal element 33 which is bent in the direction of the armature 23 can be longer than when the bimetal element 33 is positioned parallel to the centre line of the armature 23. It is also possible to attach the bimetal element 33 to the base side 32 of the yoke at the one side adjacent to the longitudinal axis of the armature 23 and to allow the end of the bimetal element 33 at the other side of the longitudinal axis of the armature 23 to engage on the stop 26 of the head member 25.

The bimetal element 33 shown is of the so-called indirectly heated type, the bimetal element being provided with a separate heating element in the form of a heating winding 54 of resistance wire, which is shown in cross-section, and which is incorporated in the circuit to be protected or to which a further current proportional to the current to be protected is supplied. For polyphase applications, several bimetal elements, or one bimetal element with several heating elements, can be employed. In stead of indirectly heated bimetal elements, it is, of course, also possible to use so-called directly heated bimetal elements, in which case the bimetal element is provided in the vicinity of its ends with flexible electrically conducting connection wires (not shown).

In FIG. 3*a* the trip device is shown in its first position in which the armature 23 lies against the shunt plate 31 under the influence of the action of the magnetic force of the permanent magnet 22, via the first magnetic circuit. As can clearly be seen from FIG. 3*a*, the other end of the armature 23 is located at a distance from the face of the leg 19 which faces towards the leg 20. As a consequence of the relatively high magnetic resistance which the head member 25 forms, there will be virtually no magnetic field from the permanent magnet 22 in the second magnetic circuit.

An electric current flowing through the magnet winding 30 will generate a magnetic field in the second magnetic circuit, which field will tend to close via the section of the armature 23 with the bore 29 and the legs 19 and 20. Irrespective of the polarity of the magnetic field, a magnetic force will be exerted on the armature 23 in the direction towards the leg 19 in order magnetically to close the second magnetic circuit. If the current in the magnet winding 30 rises above a predetermined threshold value, at which the said force acting on the armature is greater than the force exerted hereon by the permanent magnet 22 in the first magnetic circuit, the armature 23 will be pulled away from the shunt plate 31 and will be further moved, under the influence of the compression spring 27, to its second position, the head member 25 then protruding further to the outside than is shown in FIG. 3*a* and 3*b*. In this case, the movement of the armature 23 is, as desired, independent of the direction of the current through the magnet winding 30 and is consequently suitable for being actuated directly by an alternating current.

In the case of polyphase systems, several magnet windings 30 can, of course, be arranged between the legs 19 and 20 of the yoke 18. The threshold value above which the armature 23 is moved via the magnetic field in the second magnetic circuit is dependent, inter alia, on the strength of the compression spring 27, the strength of the permanent magnet 22, the magnetic material used for the yoke 18 and the armature 23 and the magnetic resistance in the second magnetic circuit.

This magnetic resistance is determined by the material from which the head member 25 is made and the distance between the inwardly facing side of the leg 19 and the end of the armature 23 which is opposite this. If the head member 25 and the armature 23 are connected to one another by, for example, a screw thread, it is simple to vary the distance between the leg 19 and the opposite end of the armature 23 and thus the magnetic resistance of the second magnetic circuit and consequently the threshold value.

A relatively simple change in this threshold value can be effected using the shunt plate 31, with which the magnetic field in the first magnetic circuit can be influenced. If the shunt plate 31 is moved further in the direction towards the base side 32 of the yoke 18, the attracting force exerted on the armature 23 decreases and the trip device will consequently show changed excitation characteristics. With the aid of the shunt plate 31, tolerance deviations can be compensated for in a simple manner, or the trip device can be adjusted to react to a specific nominal current strength, for example in order to achieve the selectivity, mentioned in the introduction, between the successive automated switches in a circuit.

As already mentioned above, setting to the nominal current strength can likewise take place by varying the number of turns on the magnet winding 30 and/or the distance between the leg 19 and the opposite end of the armature 23.

The magnetic force acting on the armature 23 in the first magnetic circuit can furthermore also be adjusted by adapting the cross-section of the section of the armature 23 which is located in the first magnetic circuit. In FIG. 3*a* the end of the armature 23 close to the shunt plate is of reduced cross-section, with the consequence that, in the first position, the armature is magnetically virtually saturated at this location under the influence of the permanent magnet. The so-called "sticking" of the armature can be prevented by suitably rounding (not shown) the end located opposite the shunt plate 31 or by giving the shunt plate 31 a nonuniform cross-section.

In order also to move the armature 23 under the influence of a detected fault current to earth, a further magnet winding can be arranged around the armature between the legs 20 and 21 of the yoke 18. In FIG. 3*a* a further magnet winding 34 for this purpose is indicated schematically by broken lines. As already mentioned in the introduction, an undesired difference between the phase current and zero current is in general detected by a ring core transformer and the detected signal is made available, for example in the form of a direct current. This direct current is then supplied to the further magnet winding 34 in such a way that the magnetic field provided by the permanent magnet 22 in the first magnetic circuit is weakened and the armature 23 can consequently be moved under the influence of the compression spring 27.

Overload currents which are permissible for some time without a risk of overheating of the electrical installation are detected under the influence of the action of the bimetal element 33. This bimetal element 33 is arranged such that, on heating, the free end bends in the direction towards the stop 26 of the head member 25 of the armature. By this means, the first magnetic circuit will be broken in the course of time and the armature 23 will be moved to the second position under the influence of the compression spring 27. Because the bimetal element 33 has to supply only the force needed to break the first magnetic circuit, this element can be kept of relatively light construction, that is to say with a low mass.

In order to prevent undesired current paths in the case of bimetal elements of the directly heated type, it is necessary that each bimetal element 33 engages mutually and, in an electrically insulated manner, on the armature. For this purpose, for example, the stop 26 can be made of electrically insulating material or can be provided with a suitable covering of electrically insulating material. Of course, the free end of the bimetal element 33 can also be provided with suitable electrically insulating means for engaging on the stop 26. Furthermore, the fixing of the bimetal element 33 to the yoke 18 can likewise be carried out in an electrically insulating manner.

In the embodiment according to FIGS. 3*a* and *b*, U-shaped yokes combined in a single essentially S-shaped structural whole are used for the first and second magnetic circuits. However, it will be clear that the U-shaped yokes can also be combined in an essentially E-shaped whole.

In order to prevent the armature being pulled too far towards a certain side as a consequence of the asymmetrical field distribution in a U-shaped yoke, a closed or virtually closed U-shape can also be used in place of an open U-shaped yoke. In principle, the yoke 18 can consist either of one single component or of separate yokes. From the structural standpoint, however, the latter option has the disadvantage of alignment of the respective feed-through openings for the armature, the fixing of the yokes to one another without air gaps as far as possible, etc . . . Deviating from the embodiment shown, the head member 25 can, for example, also be attached to the relevant end face of the armature 23 by gluing.

FIG. 4*a* shows a side view, partially shown in cross-section, of an embodiment of the trip device according to the invention which is based on the passive principle, having an approximately U-shaped yoke 35 of magnetic material with a base side 32 and legs 20 and 21 respectively. A permanent magnet 22 is again arranged between the two legs 20 and 21. A rod-shaped armature 23 of magnetic material is again arranged so as to be movably supported in the extension of the magnet axis (N-S) of the permanent magnet 22. The leg 20 is provided with a feed-through opening such that a portion of the armature 23 can protrude outside the yoke 35.

The armature 23 and the permanent magnet 22 are likewise held by a support body 24, matched to their respective shapes, between the legs 20 and 21 of the yoke 25. For clarity, the section of the supporting body 24 which is located between the legs 20 and 21 is now also shown in cross-section.

A cylindrical head member 36 is formed at the end of the armature 23 which protrudes outside, the side of the head member 36 which faces towards the leg 20 of the yoke forming a stop for a compression spring 27 fitted around the section of the armature 23 which protrudes to the outside. The other end of this compression spring 27 rests against the surface of the leg 20 which faces outwards.

A U-shaped bimetal element 37 is fitted between the base side 32 of the yoke and the armature 23 in such a way that the elongated base side 38 of said elements is located at a distance from the legs 20 and 21 of the yoke. The bimetal element 37 is firmly attached by the one leg 39 to the leg 21 of the yoke and with its other leg 40 can freely engage on the head member 36 of the armature 23.

The permanent magnet 22, the section of the armature 23 which is located within the yoke 35, the base side 32 and the parts of the legs 20 and 21 of the yoke 35 which connect thereto and a shunt plate 31 of magnetic material which is arranged in a movable manner between the permanent magnet 22 and the end of the armature 23 which is located within the legs 20 and 21 form a first magnetic circuit.

FIG. 4*b* shows the view of the trip device seen from the side where the armature 23 protrudes outside the yoke 35. The free end of the leg 20 is, for example, constricted step-wise and provided with a T-shaped twist lug 41 with which the yoke can be attached to a substrate in a known manner. The previously mentioned fixing of the support body 24 relative to the yoke 35 is effected by means of the steps 42 obtained by the constriction of the free end of the leg 20. The leg 21 of the yoke is correspondingly constricted and provided with a twist lug 41.

FIG. 4*c* shows a view of the trip device seen from the base side 32 of the yoke. The bimetal element 37 shown is again of the directly heated type and is provided with flexible electrically conducting connection wires (not shown) on its legs 39 and 40. Of course, an indirectly heated bimetal element can also be used instead of a directly heated bimetal element in this embodiment. For polyphase applications, several directly heated bimetal elements 37, or an indirectly heated bimetal element with several heating elements, can be employed in this embodiment also. In all instances, the necessary insulation measures are taken to avoid undesired current paths. The head member 36 can be made, for example, of electrically insulating material or can be provided with a suitable casing of electrically insulated material to avoid undesired current paths in the case of bimetal elements of the directly heated type. Of course, the leg 40 of the bimetal element can also be provided with suitable electrically insulating means for engaging on the armature 23 or the head member 36 hereof.

As can be seen from FIG. 4*c*, a rectangular opening 43 is formed in the base side 32 of the yoke in such a way that the parts of the base side 32 which adjoin the outer circumference of the yoke at the location of this opening form two magnetic branches 44 and 45, separated by means of air. These two magnetically separate branches 44 and 45 form a second magnetic circuit which is connected magnetically in series with the first magnetic circuit. The two branches are encircled by a single magnet winding 46 of electrically conducting material, as shown on an enlarged scale in perspective view in FIG. 5.

The support body 24 is shaped such that a further magnet winding 34 can be fitted around the armature 23 if necessary in order also to move the armature 23 under the influence of a detected fault current to earth, the various features being as shown schematically in FIG. 4*a*. The functioning of the trip device is now as follows.

Assume that the yoke 35 is produced of magnetic material having a hysteresis loop 47 shown in FIG. 6. The ends of the hysteresis loop are the regions in which the material is magnetically saturated. The field strength H of the permanent magnet 22 is now chosen so that the yoke 35 is set close to the start of its saturation, for example the set point indicated by A in FIG. 6. The attracting force exerted by the permanent magnet 22 on the armature 23 and the repelling force exerted by the compression spring 27 on the armature are now matched to one another in such a way that in the initial position of the trip device a resultant force acting in the direction towards the permanent magnet is exerted on the armature. If this attracting force is subsequently influenced in such a way that the force exerted by the compression spring 27 starts to predominate, the armature 23 will be moved by its head member 36 in the direction away from the leg 20 of the yoke. Under the influence of this movement, the contacts of an electrical switch, for example for breaking a circuit, can then be opened.

Now consider FIG. 5. The two identical magnetically separate branches 44 and 45 are each encircled by the magnet turn 46 plaited in the form of an "8" in such a way that the magnetic fields generated in the branches 44 and 45 under the influence of an electric current flowing in the magnet turn 46 are of equal size but opposite. The magnetic field provided by the permanent magnet 22 will consequently be intensified in one branch and weakened in the other branch. If the yoke is, as discussed, magnetically preset at the point A in FIG. 6, it will be clear that the total magnetic induction B in the magnetic circuit decreases as a consequence of the non-linear pattern of the hysteresis loop. If this decrease is sufficiently large, the armature will then be moved under the influence of the compression spring 27. The direction in which the current flows through the magnet turn 46 has no influence on the flux decrease and the requirement is therefore met that the switch-off characteristics for short-circuit currents and relatively high overload currents are independent of the polarity, at the particular instant, of the current to be switched off.

It has been found that if the field strength of the permanent magnet 22, the spring action of the compression spring 27 and the magnetic characteristics of the yoke 35 and the armature 23 are suitably chosen the magnetic field in the magnetic circuit can be sufficiently attenuated by a magnet winding consisting of a single turn to effect a movement of the armature. This has the advantage that this magnet winding 46 can be incorporated directly in the circuit to be protected and the wire thickness hereof can be dimensioned to the maximum short-circuit current to be expected. By forming several mutually separate branches in the magnetic circuit, for example via several openings 43, an even greater attenuation of the magnetic field can be effected by installing a single magnet winding 46 in accordance with FIG. 5. By installing several magnet windings which are electrically insulated from one another it is possible, for example, to protect an electrical polyphase energy distribution installation in a simple manner using one trip device. Of course, a separate opening 43 with associated magnet winding 46 can also be provided for each phase.

The bimetal element 37 is installed in such a way that, on heating, the free end of said element bends in the direction away from the legs 20 and 21 of the yoke. As the base side 38 of the bimetal element 37 moves further away from the yoke, the leg 40 of the bimetal element will, from a certain position, exert a force on the head member 36 of the armature in the direction away from the leg 20 of the yoke. As a consequence, the first magnetic circuit will be broken, as a result of which the magnetic resistance hereof increases and the armature 23 is moved further outwards relative to the yoke 35 under the influence of the compression spring 27.

The deflection of the bimetal element relative to the yoke also remains relatively small as a consequence of the chosen U-shape of the bimetal element. As a consequence of this, after the overload current has been switched off, the bimetal will return relatively quickly to its initial position as shown in FIG. 4*c*, so that the armature can relatively quickly be returned again to its initial position as shown in FIG. 4*a*, by an external force.

A compact and sensitive construction which takes up little space and which can be installed in the generally relatively small casing of automated switches is provided by the chosen arrangement of the various components of the trip device. If, for example, the location of the magnet winding 46 presents problems when installing the trip device in switches, a separate body can advantageously be used for incorporating a second magnetic circuit with magnetically separate branches in series with the first magnetic circuit.

In FIG. 7 an elongated cylindrical body 48 of magnetic material is shown diagrammatically in perspective view for this purpose, which body can, for example, be incorporated between the permanent magnet 22 and the armature 23, with the longitudinal axis in the direction of the magnet axis (N-S) of the permanent magnet 22.

With the aid of the opening 49 made in the radial direction of the body 48, two branches 50 and 51 are provided which are magnetically separated from one another by air and are comparable to the magnetically separate branches 44 and 45 of the base side 32 of the yoke. Recesses 52, for receiving a magnet winding 46 as shown in FIG. 5, are formed in the jacket surface of the cylindrical body 48 at the location of the branches 50 and 51.

It will be clear that the body 48 can also have other suitable shapes, if necessary with several mutually magnetically separate branches. If such a separate body 48 is used, the permanent magnet 22 must have a strength such that at least this body 48 is set in or close to its saturation point.

It is self-evident that the invention is not restricted to the illustrative embodiments shown in the figures, but that many modifications, additional features and mutual combinations are possible, such as in respect of the location and the shape of the bimetal element, the shape of the armature and the yoke, the optional use of a shunt plate or a further magnet winding for switching off in the case of fault currents to earth etc., without going beyond the framework and the scope of the invention.

I claim:

1. A trip device for an electrical switch, comprising:

a yoke of magnetic material;

an elongated armature supported by said yoke, an end section of said armature protruding through said yoke, said armature being movable between a first and second position, said end section protruding further from said yoke with said armature in said second position than in said first position;

spring means attached to said armature for moving it to said second position;

a permanent magnet fixedly arranged such that said magnet, yoke and armature form a first magnetic circuit for holding said armature in said first position under the influence of the magnetic flux by said permanent magnet and against the force of said spring means;

at least one magnet winding for electromagnetically moving said armature to said second position; and a second magnetic circuit for moving said armature to said second position independently of the polarity of electric current flowing in said at least one magnet winding, and comprising a further yoke of magnetic material containing said end section, the outwardly facing end of said end section merging into a head member having a higher magnetic resistance than said armature, said head member protruding through a face of the further yoke towards the outside such that the outwardly facing end of said end section is located, in said first position, at a distance from said face, said end section being surrounded by said at least one magnet winding.

2. A trip device according to claim 1, wherein the yoke are a single structural unit, each yoke having an essentially U-shaped cross section, said structural unit having as a whole an essentially S-, E-, 8- or 9-shaped cross section comprising two pairs of adjacent faces, a first of said pairs of adjacent faces being provided with opposite feed-through openings for accommodating said armature, said at least one magnet winding being arranged between a first pair of said two pairs of adjacent faces, said permanent magnet being arranged between a second pair of said two pairs of adjacent faces opposite an other end of said armature.

3. A trip device according to claim 2, wherein said head member is made of plastic and being fixed to fit partly into said armature.

4. A trip device according to claim 2, further comprising a sleeve of magnetic non-conducting material is arranged between said first pair of adjacent faces, said sleeve extending in the feed-through openings for passing said end section and part of said head member through said sleeve and said at least one magnet winding being disposed around said sleeve.

5. A trip device according to claim 2, further comprising a further magnet winding, arranged around said armature and inside said one yoke, for attenuating electromagnetically the magnetic field of said permanent magnet in said first magnetic circuit by a further electric current flowing in said further magnet winding, in order to move the said armature to said second position under the force of said spring means.

6. A trip device according to claim 1, further comprising an adjustable shunt of magnetic material positioned adjacent the opposite other end of said armature and the permanent magnet between said second pair of adjacent faces, in order to influence the magnetic field in said first magnetic circuit.

7. Trip device according to claim 6, wherein the shunt is a movably arranged plate.

8. A trip device according to claim 1, wherein the cross section of the armature is reduced in the vicinity of the permanent magnet, such that the armature is in the first position magnetically virtually saturated at said reduced cross section by the magnetic flux of the permanent magnet.

9. A trip device according to claim 1, further comprising bimetal means comprising at least one elongated electrothermal bimetal element, one end of said at least one bimetal element being fixed to the yoke and another end engaging in a freely movable manner on the head member to move the armature to the second position when heated.

10. A trip device according to claim 9, wherein the at least one elongated bimetal element is arranged such that its longitudinal axis makes an acute angle with the longitudinal axis of the elongated armature.

11. A trip device according to claim 9, wherein the at least one bimetal element is approximately U-shaped and is located with its base side essentially parallel to the armature, one leg of the at least one bimetal element being fixed at a face of said one yoke through which the armature does not protrude and another leg of the at least one bimetal element engaging said head member.

12. A trip device for an electrical switch, comprising:

a yoke of magnetic material;

an elongated armature supported by said yoke, an end section of said armature protruding through said yoke, said armature being movable between a first and second position, said end section protruding further from said yoke with said armature in said second position than in said first position;

spring means attached to said armature for moving it to said second position;

a permanent magnet fixedly arranged such that said magnet, yoke and armature form a first magnetic circuit for holding said armature in said first position under the influence of the magnetic flux by said permanent magnet and against the force of said spring means;

at least one magnet winding for electomagnetically moving said armature to said second position; and a second magnetic circuit for moving said armature to said second position independently of the polarity of electric current flowing in said at least one magnet winding, and comprising at least one pair of mutually magnetically separate branches of magnetically conducting material and connected magnetically in series with said first magnetic circuit, said at least one magnet winding such that the branches are mutually oppositely magnetized by said electrical current, whereby the resultant magnetic flux acting on the armature becomes smaller than the magnetic flux of the permanent magnet acting on the armature in said first position, to move the armature to said second position under the action of said spring means.

13. Trip device according to claim 12, wherein the second magnetic circuit is formed by at least one opening made in the yoke, the sections of the yoke adjoining this at least one opening forming the at least one pair of mutually magnetically separate branches.

14. Trip device according to claim 12, wherein the at least one pair of mutually magnetically separate branches of the second magnetic circuit is formed in at least one body of magnetic material positioned in the longitudinal direction of the armature.

15. Trip device according to claim 14, wherein the at least one body is essentially rod-shaped and has at least one opening extending in radial direction, such that the sections of the at least one body which adjoin the at least one opening, seen in the longitudinal direction, form the at least one pair of mutually magnetically separate branches.

16. A trip device according to claim 12 further comprising a further magnet winding, arranged around said armature and inside said one yoke, for attenuating electromagnetically the magnetic field of said permanent magnet in said first magnetic circuit by a further electric current flowing in said further magnet winding, in order to move the said armature to said second position under the force of said spring means.

17. A trip device according to claim 12 further comprising an adjustable shunt of magnetic material positioned adjacent the opposite other end of said armature and the permanent magnet between said second pair of adjacent faces, in order to influence the magnetic field in said first magnetic circuit.

18. A trip device according to claim 12 wherein the cross section of the armature is reduced in the vicinity of the permanent magnet, such that the armature is in the first position magnetically virtually saturated at said reduced cross section by the magnetic flux of the permanent magnet.

19. A trip device according to claim 12 further comprising bimetal means comprising at least one elongated electrothermal bimetal element, one end of said at least one bimetal element being fixed to the yoke and another end engaging in a freely movable manner on the head member to move the armature to the second position when heated.

20. A trip device according to claim 19, wherein the at least one elongated bimetal element is arranged such that its longitudinal axis makes an acute angle with the longitudinal axis of the elongated armature.

21. A trip device according to claim 19, wherein the at least one bimetal element is approximately U-shaped and is located with its base side essentially parallel to the armature, one leg of the at least one bimetal element being fixed at a face of said one yoke through which the armature does not protrude and another leg of the at least one bimetal element engaging said head member.

22. Trip device according to claim 2, wherein the two yokes are integrated.

* * * * *